US005861852A

United States Patent [19]

Asakura et al.

[11] Patent Number: 5,861,852

[45] Date of Patent: Jan. 19, 1999

[54] CHIP ANTENNA

[75] Inventors: Kenji Asakura, Shiga-ken; Teruhisa Tsuru, Kameoka; Seiji Kanba, Otsu; Tsuyoshi Suesada, Omihachiman, all of Japan

[73] Assignee: Murata Mfg. Co. Ltd., Kyoto, Japan

[21] Appl. No.: 827,782

[22] Filed: Apr. 11, 1997

[30] Foreign Application Priority Data

Apr. 16, 1996 [JP] Japan ..... 8-094374

[51] Int. Cl.[6] ..... H01Q 1/24

[52] U.S. Cl. ..... 343/702; 343/702; 343/895; 343/787; 343/788

[58] Field of Search ..... 343/702, 895, 343/787, 788, 718; H01Q 1/24

[56] References Cited

U.S. PATENT DOCUMENTS

| | | | |
|---|---|---|---|
| 5,014,071 | 5/1991 | King | 343/788 |
| 5,760,746 | 6/1998 | Kawahata et al. | 343/702 |
| 5,764,197 | 6/1998 | Tsuro et al. | 343/702 |
| 5,764,198 | 6/1998 | Tsuro et al. | 343/702 |
| 5,767,811 | 6/1998 | Mandai et al. | 343/702 |
| 5,767,817 | 6/1998 | Tsuro et al. | 343/895 |

FOREIGN PATENT DOCUMENTS

| | | |
|---|---|---|
| 621653 | 10/1994 | European Pat. Off. . |
| 687030 | 12/1995 | European Pat. Off. . |

*Primary Examiner*—Frank G. Font
*Assistant Examiner*—Layla G. Lauchman
*Attorney, Agent, or Firm*—Ostrolenk, Faber, Gerb & Soffen, LLP

[57] ABSTRACT

A downsized chip antenna having a large bandwidth ratio is disclosed. The chip antenna has a rectangular prism-shaped base member providing a mounting surface. A conductor is formed inside the base member in such a manner that it is spirally wound around a winding axis, for example, a winding axis parallel to the mounting surface, i.e., in the longitudinal direction of the base member. One end of the conductor is extended to a surface of the base member to form a feeding section, which is connected to a feeding terminal, disposed over the surfaces of the base member to apply voltage to the conductor. In one embodiment, the other end of the conductor is connected to a midway portion of the conductor within the base member, thereby forming a loop in said conductor.

31 Claims, 5 Drawing Sheets

CHIP ANTENNA

BACKGROUND OF THE INVENTION

1. Field of the Invention

The present invention relates generally to chip antennas and, more particularly, to chip antennas for use in mobile communications and local area networks (LAN).

2. Description of the Related Art

Referring to a side view of a known type of chip antenna shown in FIG. 11, a chip antenna generally indicated by 50 includes: a rectangular-prism-shaped insulator 51 formed by laminating insulating layers (not shown) made from insulating powder, such as alumina or steatite; a silvermade or silver-palladium-made conductor 52 formed in a coil-like shape inside the insulator 51; a magnetic member 53 made from magnetic powder, such as ferrite powder, and formed inside the insulator 51 and the coil-shaped conductor 52; and external connecting terminals 54*a* and 54*b*. The connecting terminals 54*a* and 54*b* are attached to the ends of a lead (not shown) of the conductor 52 and baked after the insulator 51 has been fired. The chip antenna 50 is thus constructed in such a manner that the coil-shaped conductor 52 is wound around the magnetic member 53, and both the elements are encapsulated by the insulator 51.

The following problem is, however, encountered by the above conventional type of chip antenna. That is, the bandwidth ratio is disadvantageously decreased when this chip antenna is downsized.

SUMMARY OF THE INVENTION

Accordingly, it is an object of the present invention to provide a downsized chip antenna having a large bandwidth ratio, free from the above-described problem.

In order to achieve the above and other objects, according to one form of the present invention, there is provided a chip antenna comprising: a base member made from at least one of a dielectric material and a magnetic material; at least one conductor formed at least on a surface of or inside the base member; and at least one feeding terminal formed on a surface of the base member, for applying voltage to the conductor, wherein the conductor is connected at one end to the feeding terminal and at the other end to a portion of the conductor other than the end of the conductor connected to the feeding terminal.

According to the chip antenna noted above, at least one conductor formed at least on a surface of or inside the base member is connected at one end to the feeding terminal and at the other end to a portion of the conductor other than the end of the conductor connected to the feeding terminal. With this construction, the inductance of the conductor can be decreased, thereby enabling an increase in the resonant frequency. Also, the other end of the conductor leads to a portion located midway within the conductor, and this midway portion of the conductor looks apparently greater in width. Hence, the radiating efficiency of the chip antenna can be enhanced, thereby increasing the band width ratio.

According to another form of the present invention, there is provided a chip antenna comprising: a base member made from at least one of a dielectric material and a magnetic material; at least one conductor formed at least one of on a surface of and inside the base member; and at least one feeding terminal formed on a surface of the base member, for applying voltage to the conductor, wherein the conductor is connected at both one end and the other end to the same feeding terminal so as to be formed in a loop-like shape.

According to the chip antenna described above, at least one conductor formed at least one of on a surface of and inside the base member is connected at both ends to the feeding terminal so as to be formed in a loop-like shape. Thus, the inductance of the conductor can be made even smaller, thereby achieving an increase in the resonant frequency without needing to shorten the conductor, i.e., without lowering the gain of the chip antenna.

In the above-described chip antenna, one portion of the loop-like conductor may be short-circuited with another portion of the conductor. With this arrangement, since at least one loop-like conductor disposed at least one of on a surface of and inside the base member is short-circuited in at least one portion, the inductance of the conductor can be decreased to a smaller level. It is thus possible to increase the resonant frequency without requiring a change to the overall length of the conductor.

Other features and advantages of the present invention will become apparent from the following description of the invention which refers to the accompanying drawings.

DETAILED DESCRIPTION OF EMBODIMENTS OF THE INVENTION

Figure 1:
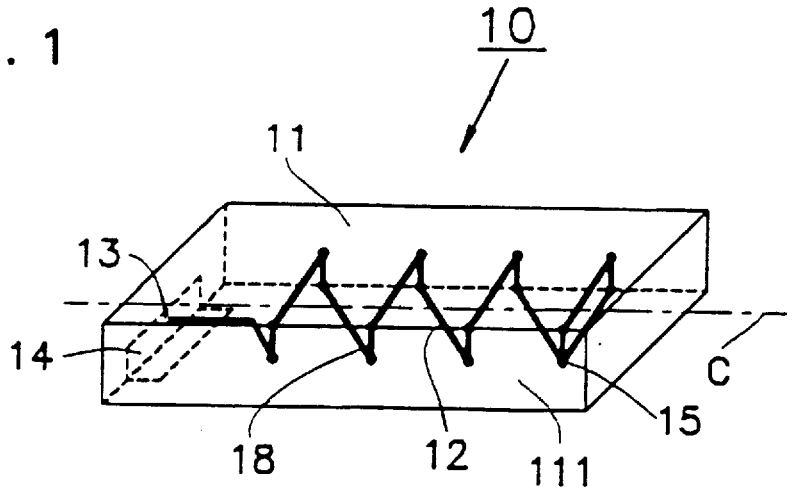
FIG. 1 is a perspective view of a chip antenna according to a first embodiment of the present invention.

A description will now be given of embodiments of the present invention while referring to the drawings. In the below-described second and third embodiments, elements identical or similar to those of a first embodiment are designated by like reference numerals, and a detailed explanation thereof will thus be omitted.

Figure 2:
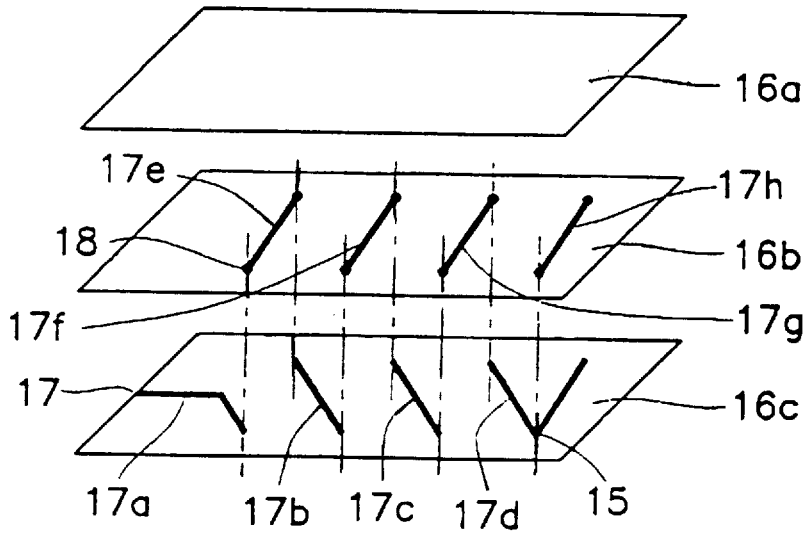
FIG. 2 is an exploded perspective view of the chip antenna shown in FIG. 1.

A reference will first be made to FIGS. 1 and 2 illustrating a perspective view and an exploded perspective view, respectively, of a chip antenna according to a first embodiment of the present invention. A chip antenna generally designated by 10 includes a rectangular-prism shaped base member 11 having a mounting surface 111, and a conductor 12 formed within the base member 11. The conductor 12 is spirally wound in the direction of the winding axis C positioned in parallel to the mounting surface 111, i.e., in the longitudinal direction of the base member 11. One end of the conductor 12 is extended to a surface of the base member 11 to form a feeding section 13, which is connected to a feeding terminal 14, disposed over the surfaces of the base member 11 to apply voltage to the conductor 12. The other end of the conductor 12 is connected inside the base member 11 to a portion of the conductor 12 other than the feeding section 13 (which is one end of the conductor 12), for example, to a portion 15 positioned midway in the conductor 12 (hereinafter referred to as "the midway portions").

The base member 11 is formed, as illustrated in FIG. 2, by laminating rectangular sheet layers 16*a* through 16*c* made from a dielectric-material (relative dielectric constant: 6.1) comprising e.g., barium oxide, aluminum oxide and silica. Formed on the surfaces of the sheet layers 16*b* and 16*c* are copper-made or copper-alloy-made conductive patterns 17*a* through 17*h* formed generally in an "L" shape or in a linear shape by means such as printing, vapor deposition, cladding, or plating. Also, via-holes 18 are provided in predetermined positions (both ends of the individual conductive patterns 17*e* through 17*h*) in the sheet layer 16*b* in the thickness direction. Then, the sheet layers 16*a* through 16*c* are laminated and sintered, and the conductive patterns 17*a* through 17*h* are connected by via holes 18. Thus, the above-described spirally-wound conductor 12 having a rectangular cross section can be formed in which one end of the conductor 12 serves as the feeding section 13 and the other end is connected to the midway portion 15 of the conductor 12.

Figure 3:
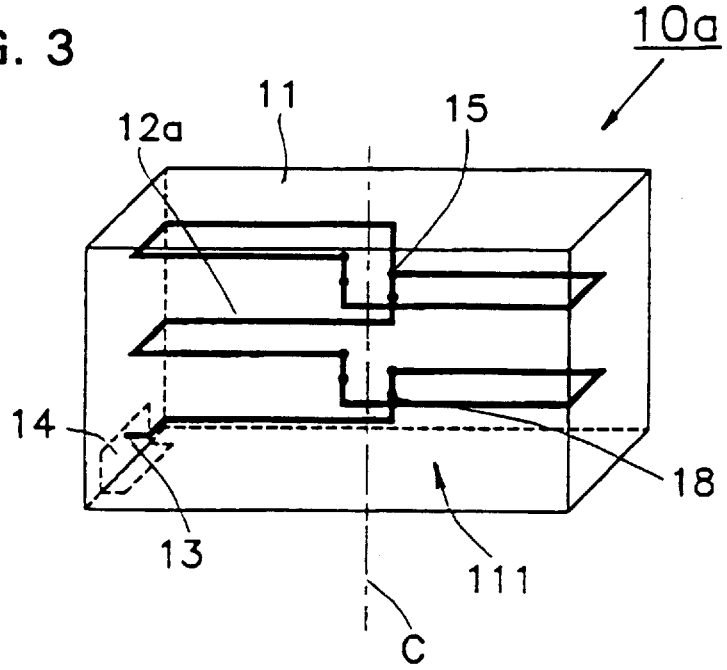
FIG. 3 is a perspective view of an example of modifications of the chip antenna shown in FIG. 1.

FIG. 3 is a perspective view of an example of modifications of the first embodiment. The chip antenna 10*a* differs from the chip antenna 10 of the first embodiment in that a conductor 12*a* is spirally wound in the direction of the winding axis C of the conductor 12*a* which winding axis is orthogonal to the mounting surface 111, i.e. in the direction along the height of the base member 11. The conductor end loops back and connects to a midway portion at point 15.

Figure 4:
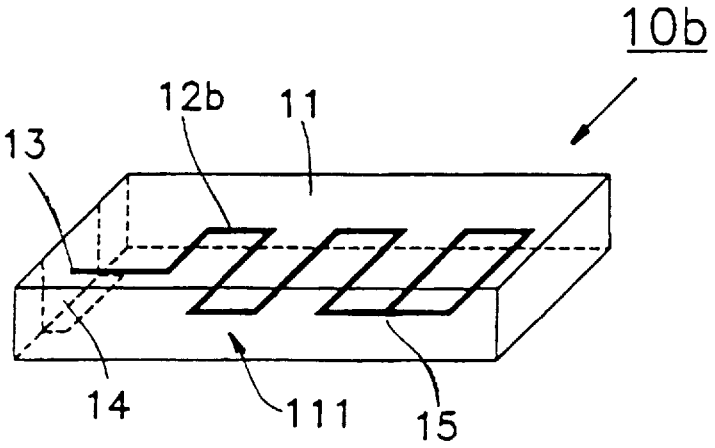
FIG. 4 is a perspective view of another example of modifications of the chip antenna shown in FIG. 1.

FIG. 4 is a perspective view of another example of modifications of the first embodiment. The chip antenna 10*b* is different from the chip antenna 10 of the first embodiment in that a conductor 12*b* is formed in a meandering shape. The conductor end loops back and connects to a midway portion at point 15.

As described above, since the chip antenna of the first embodiment is constructed such that the spirally-formed or meanderingly-shaped conductor is connected at one end to the feeding terminal and at the other end to a midway portion of the conductor, the inductance of the conductor can be decreased, thereby increasing the resonant frequency. Additionally, the end of the conductor is connected to its midway portion so as to form a loop-like shape, and thus, such a loop-like portion looks apparently larger in width. Accordingly, the radiating efficiency of the chip antenna can be improved, thereby enabling an increased bandwidth ratio.

Figure 5:
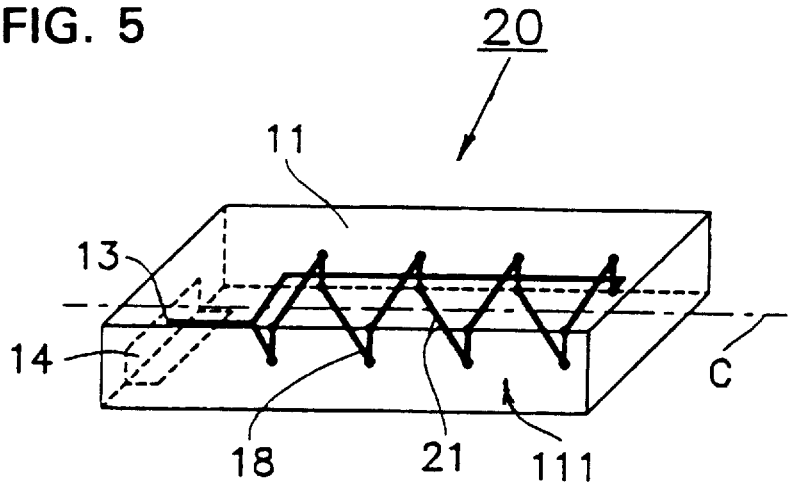
FIG. 5 is a perspective view of a chip antenna according to a second embodiment of the present invention.

FIG. 5 is a perspective view of a chip antenna according to a second embodiment of the present invention. The chip antenna generally represented by 20 differs from the chip antenna 10 of the previous embodiment in the following point. Both ends of a conductor 21 disposed within the base member 11 are connected to the feeding terminal 14 which is formed over the surfaces of the base member 11 to apply voltage to the conductor 21. The conductor 21 is thus wholly formed in a loop-like shape.

Figure 6C:
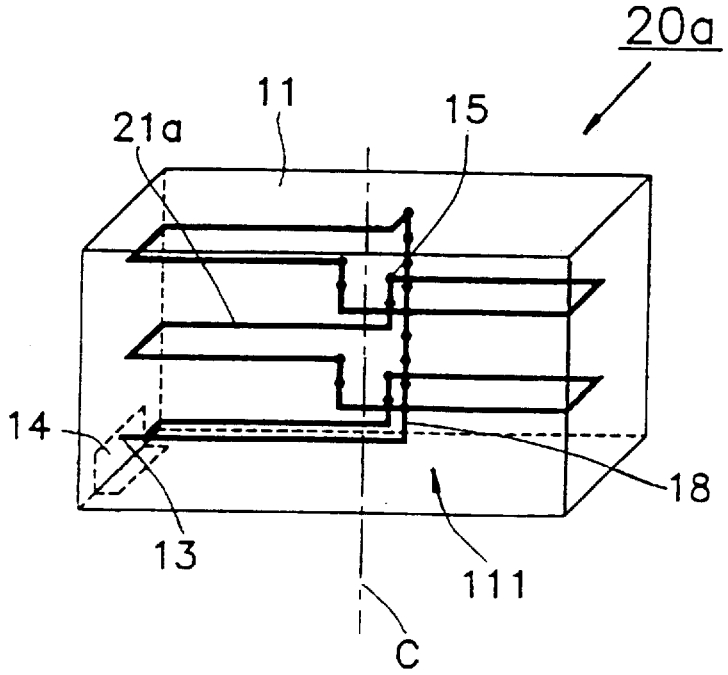
FIG. 6 is a perspective view of an example of modifications of the chip antenna shown in FIG. 5.

An example of modifications of the second embodiment is shown in FIG. 6. The chip antenna 20*a* differs from the chip antenna 20 of the second embodiment in that a conductor 21*a* is spirally wound in the direction of the winding axis C of the conductor 21*a* which winding axis is orthogonal to the mounting surface 111, i.e. in the direction along the height of the base member 11.

Figure 7:
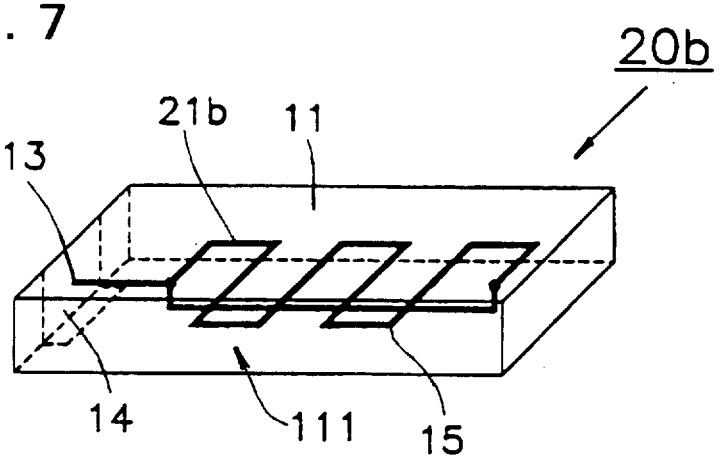
FIG. 7 is a perspective view of another example of modifications of the chip antenna shown in FIG. 5.

FIG. 7 is a perspective view of another example of modifications of the second embodiment. The chip antenna 20*b* is different from the chip antenna 20 of the second embodiment in that a conductor 21*b* is formed in a meandering shape.

As discussed above, the chip antenna of the second embodiment is constructed in such a manner that the spirally-formed or meanderingly-shaped conductor is connected at both ends to the feeding terminal to form a wholly loop-like shape, so that the inductance of the conductor can be made even smaller as compared with the first embodiment. Accordingly, the resonant frequency can be increased to a greater level without needing to decrease the length of the conductor, i.e., without lowering the gain of the antenna.

Figure 8:
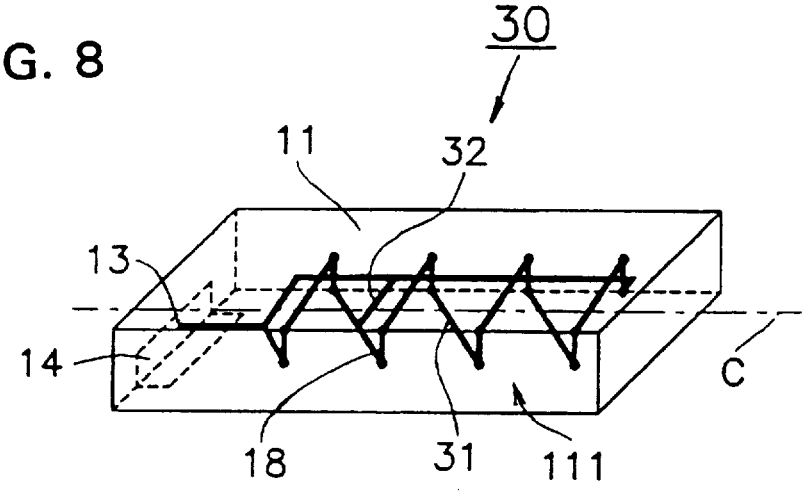
FIG. 8 is a perspective view of a chip antenna according to a third embodiment of the present invention.

A chip antenna of a third embodiment of the present invention is shown in FIG. 8. The chip antenna generally indicated by 30 is different from the chip antenna 20 of the second embodiment in that one portion of a loop-like conductor 31 is short-circuited with another portion of the conductor 31 through a conductor 32.

Figure 9:
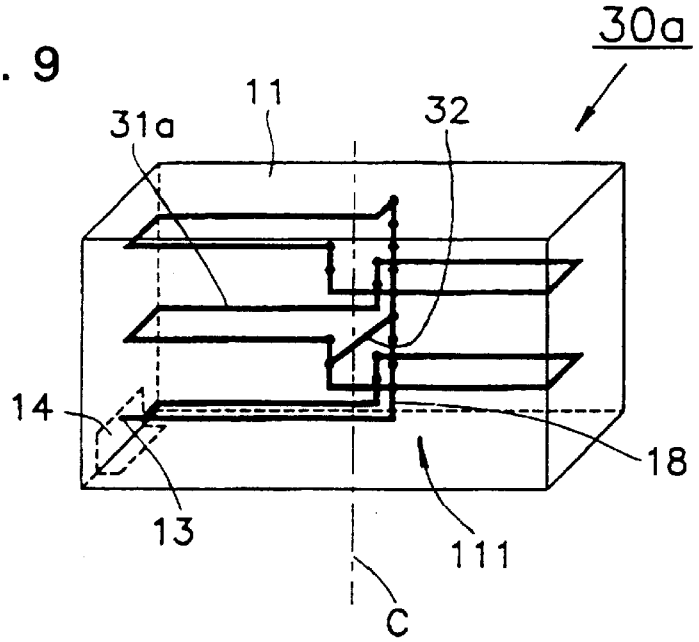
FIG. 9 is a perspective view of an example of modifications of the chip antenna shown in FIG. 8.

An example of modifications of the third embodiment is shown in FIG. 9. The chip antenna 30*a* differs from the chip antenna 30 of this embodiment in that a conductor 31*a* is spirally wound in the direction of the winding axis C of the conductor 31*a* which winding axis is orthogonal to the mounting surface 111, i.e. in the direction along the height of the base member 11.

Figure 10:
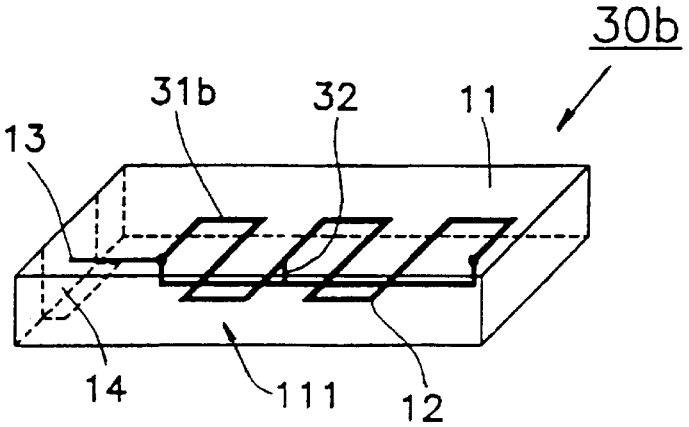
FIG. 10 is a perspective view of another example of modifications of the chip antenna shown in FIG. 8.
Figure 11:
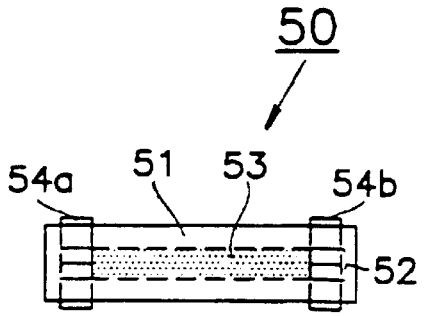
FIG. 11 PRIOR ART
FIG. 11 is a side view of a known type of chip antenna.

FIG. 10 is a perspective view of another example of modifications of the third embodiment. The chip antenna 30*b* is different from the chip antenna 30 of this embodiment in that a conductor 31*b* is formed in a meandering shape. As noted above, the chip antenna of the third embodiment is constructed in such a manner that one portion of the spirally-formed or meanderingly-shaped conductor in a loop-like shape is short-circuited with another portion of the conductor. Thus, the inductance of the conductor can be made even smaller as compared with the first and second embodiments. As a consequence, the resonant frequency can be increased without changing the overall length of the conductor.

In the first through third embodiments, the base member is made from a dielectric material preferably comprising barium oxide, aluminum oxide and silica. However, this is not exclusive, and the base member may be made from a dielectric material comprising titanium oxide and neodymium oxide, a magnetic material comprising nickel, cobalt and iron, or a combination of a dielectric material and a magnetic material.

Also, although the foregoing embodiments have been explained in which the base member is rectangular-prism shaped, it may be formed in other shapes providing a mounting surface, such as a cube, cylinder, pyramid, cone, or sphere.

Additionally, the conductors shown are formed within the base member, but it may be disposed on the surface of the base member, or may be formed both on the surface of and inside the base member. Only one conductor is provided in the above-described embodiments, but two or more conductors may be formed, in which case, a resulting chip antenna can possess a plurality of resonant frequencies.

Further, the aforedescribed embodiments have been explained in which the cross-sectional shape of the spirally-wound conductor crossing at right angles with the winding axis C is generally rectangular. However, it may be formed in other shapes as long as it partially has a linear portion. In this case, the length of the conductor can be increased to elevate the inductance of the conductor as compared with a conductor having a circular cross section, on condition that both types of conductors have the same cross-sectional area, thereby enhancing the gain of the resulting chip antenna. Additionally, such an antenna can be responsive to both main polarization in the direction of the winding axis and cross polarization in the direction perpendicular to the winding axis, thereby achieving a nondirectional chip antenna.

The number of corners provided in a meanderingly-shaped conductor is not an essential condition to carry out the present invention. Any number of corners may be formed according to the length of the conductor. Moreover, although the foregoing embodiments have been discussed in which the meandering shape is generally rectangular, it may be formed generally in a wave shape or sawtooth shape.

The position of the feeding terminal specified in the above embodiments is not essential to carry out the present invention. Further, although the loop-like conductor is connected in only one portion in the third embodiment, it may be connected in more than one portion.

Although the present invention has been described in relation to particular embodiments thereof, many other variations and modifications and other uses will become apparent to those skilled in the art. Accordingly, the present invention should be limited not by the specific disclosure herein, but only by the appended claims.

What is claimed is:

1. A chip antenna comprising: a base member made from at least one of a dielectric material and a magnetic material; at least one conductor formed at least one of on a surface of said base member and inside said base member; and at least one feeding terminal formed on a surface of said base member for applying voltage to said conductor, said conductor being connected at a first end to said feeding terminal and having a second end, the second end being connected to a portion of said conductor other than the first end of said conductor connected to said feeding terminal, thereby forming a loop in said conductor.

2. The chip antenna of claim 1, wherein said base member comprises a plurality of layers, at least two of said layers having a portion of said conductor disposed thereon, at least one through-hole being provided electrically coupling the portions on said two layers the plurality of layers being laminated together to form said chip antenna with said portions of the conductor on said two layers being electrically coupled together by said through-holes when said layers are laminated together.

3. The chip antenna of claim 1, wherein the base member has a mounting surface, the conductor comprising a spiral winding having a winding axis parallel to said mounting surface.

4. The chip antenna of claim 1, wherein the base member has a mounting surface, the conductor comprising a spiral winding having a winding axis normal to said mounting surface.

5. The chip antenna of claim 1, wherein the conductor has a meandering shape essentially formed in a plane.

6. The chip antenna of claim 1, wherein the conductor has a spiral shape.

7. The chip antenna of claim 6, wherein the conductor has a rectangular shape in cross section.

8. The chip antenna of claim 6, wherein the conductor has a cross section having at least one linear portion.

9. The chip antenna of claim 1, wherein the base member comprises barium oxide, aluminum oxide and silica.

10. The chip antenna of claim 1, wherein the base member comprise titanium oxide and neodymium oxide.

11. The chip antenna of claim 1, wherein the base member comprises a magnetic material comprising nickel, cobalt and iron.

12. The chip antenna of claim 1, wherein the base member comprises a combination of a dielectric and a magnetic material.

13. The chip antenna of claim 1, wherein the conductor is disposed both on the surface of the base member and within the base member.

14. The chip antenna of claim 5, wherein the conductor has one of a wavy shape, sawtooth shape and squarewave shape.

15. A chip antenna comprising:

a base member made from at least one of a dielectric material and a magnetic material;

at least one conductor formed at least one of on a surface of said base member and inside said base member; and at least one feeding terminal formed on a surface of said base member for applying voltage to said conductor, said conductor having first and second ends, said conductor being connected at both said first and second ends to the same feeding terminal so as to be formed in a loop-like shape.

16. The chip antenna of claim 15, wherein one portion of said loop-like conductor is short-circuited with another portion of said conductor at points on said portions between said first and second ends.

17. The chip antenna of claim 15, wherein said base member comprises a plurality of layers, at least two of said layers having a portion and said conductor disposed thereon, at least one through-hole being provided electrically coupling the portions on said two layers the plurality of layers being laminated together to form said chip antenna with said portions of the conductor on said two layers being electrically coupled together by said through-holes when said layers are laminated together.

18. The chip antenna of claim 15, wherein the base member has a mounting surface, the conductor comprising a spiral winding having a winding axis parallel to said mounting surface.

19. The chip antenna of claim 15, wherein the base member has a mounting surface, the conductor comprising a spiral winding having a winding axis normal to said mounting surface.

20. The chip antenna of claim 15, wherein the conductor has a meandering shape essentially formed in a plane.

21. The chip antenna of claim 15, wherein the conductor has spiral shape.

22. The chip antenna of claim 21, wherein the conductor has a rectangular shape in cross section.

23. The chip antenna of claim 21, wherein the conductor has a cross section having at least one linear portion.

24. The chip antenna of claim 15, wherein the base member comprises barium oxide, aluminum oxide and silica.

25. The chip antenna of claim 15, wherein the base member comprise titanium oxide and neodymium oxide.

26. The chip antenna of claim 15, wherein the base member comprises a magnetic material comprising nickel, cobalt and iron.

27. The chip antenna of claim 15, wherein the base member comprises a combination of a dielectric and a magnetic material.

28. The chip antenna of claim 15, wherein the conductor is disposed both on the surface of the base member and within the base member.

29. The chip antenna of claim 20, wherein the conductor has one of a wavy shape, sawtooth shape and squarewave shape.

30. The chip antenna of claim 16, wherein the short circuit portion comprises a portion of said conductor extending substantially parallel to a mounting surface of said base member.

31. The chip antenna of claim 16, wherein the short circuit portion comprises a portion of said conductor extending substantially perpendicular to a mounting surface of said base member.

* * * * *